US009428863B2

(12) United States Patent
Etschmaier

(10) Patent No.: US 9,428,863 B2
(45) Date of Patent: Aug. 30, 2016

(54) ROLL AND METHOD FOR PRODUCING A ROLL

(71) Applicant: VOITH PATENT GMBH, Heidenheim (DE)

(72) Inventor: Alexander Etschmaier, Neuberg (AT)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 14/419,291

(22) PCT Filed: Jul. 10, 2013

(86) PCT No.: PCT/EP2013/064569

§ 371 (c)(1),
(2) Date: May 22, 2015

(87) PCT Pub. No.: WO2014/019825

PCT Pub. Date: Feb. 6, 2014

(65) Prior Publication Data

US 2015/0308048 A1 Oct. 29, 2015

(30) Foreign Application Priority Data

Aug. 3, 2012 (DE) ..... 10 2012 213 783

(51) Int. Cl.

| | |
|---|---|
| ***D21H 17/00*** | (2006.01) |
| ***D21F 3/08*** | (2006.01) |
| ***D21G 1/02*** | (2006.01) |
| ***D21H 17/20*** | (2006.01) |
| ***D21H 17/67*** | (2006.01) |
| *B41N 7/00* | (2006.01) |

(52) U.S. Cl.

CPC ..... *D21H 17/74* (2013.01); *D21F 3/08* (2013.01); *D21G 1/0246* (2013.01); *D21H 17/20* (2013.01); *D21H 17/675* (2013.01); *B41N 7/00* (2013.01); *B41N 2207/02* (2013.01); *B41N 2207/10* (2013.01)

(58) Field of Classification Search

CPC ..... D21H 17/00; D21H 17/67; D21H 17/20
USPC ..... 162/164.1
See application file for complete search history.

(56) References Cited

U.S. PATENT DOCUMENTS

| | | | |
|---|---|---|---|
| 5,967,959 | A | 10/1999 | Niemi et al. |
| 6,167,623 | B1 | 1/2001 | Niemi et al. |
| 6,200,248 | B1 | 3/2001 | Vestola et al. |
| 6,339,883 | B1 | 1/2002 | Graf et al. |

FOREIGN PATENT DOCUMENTS

| | | | |
|---|---|---|---|
| EP | 0870867 | A1 | 10/1998 |
| EP | 0870868 | A2 | 10/1998 |

*Primary Examiner* — Mark Halpern
(74) *Attorney, Agent, or Firm* — Laurence A. Greenberg; Werner H. Stemer; Ralph E. Locher

(57) ABSTRACT

A roll for use in a machine for producing or finishing a web of fibrous material, such as a paper, paperboard or tissue web, has a roll core. At least one bonding layer is formed thereon and at least one ceramic layer is formed on the at least one bonding layer. The at least one ceramic layer at least partially is formed of an oxidic compound in the form of a mixed-oxide ceramic.

16 Claims, 1 Drawing Sheet

ROLL AND METHOD FOR PRODUCING A ROLL

This application is a 371 of PCT/EP2013/064569 filed on 10 Jul. 2013.

BACKGROUND OF THE INVENTION

Field of the Invention

The invention proceeds from a roll for use in a machine for producing or finishing a web of fibrous material, such as a paper, paperboard or tissue web. The roll comprises a roll core, at least one bonding layer formed thereon and on the at least one bonding layer at least one ceramic layer formed thereon. The invention also pertains to a method for producing such a roll.

Rolls can be found in many positions in a machine for producing web material. They perform a wide variety of tasks for guiding and conducting the fibrous web and/or the fabrics; they can dewater, press, smooth or dry the fibrous web.

The rolls can be used, for example, as the central press roll in the press section of the fibrous web machine. Here, the fibrous web arriving from the forming section makes direct contact with the surface of the roll. In the roll nip with the central press roll, a large part of the residual moisture which is still present is pressed from the fibrous web. Then, the fibrous web is removed in a free draw from the roll and transferred into the next section of the machine. This takes place with a certain longitudinal expansion and a difference in speed resulting therefrom. The difference determines the efficiency of the machine decisively. If the fibrous web can be detached from the roll surface poorly, it is overstretched and in the worst case tears, resulting in undesirable and costly machine downtimes.

In this position, use was previously made of granite rolls, the material of which comprises different phases with differing hygroscopy. Rolls of this type are not satisfactory in terms of their resistance to contamination, however. Service intervals were often required, until the granite rolls were replaced by modern rolls with covers or coatings.

Rolls as per the present prior art usually have an oxide-ceramic coating on a hard roll core.

A roll having an oxide-ceramic coating of this type is apparent, for example, from EP 0 870 867 B1. The roll has a ceramic layer with a thickness of 100 to 2000 μm which is applied to the frame portion of the roll, the roughness $R_a$ of the outer surface of the roll being 0.2 to 2.0 μm and preferably 0.4 to 1.5 μm. The ceramic layer contains 50 to 95% and preferably 55 to 80% of $Cr_2O_3$ and 3 to 50% and preferably 20 to 45% of $TiO_2$. Other metal oxides may additionally be provided.

A disadvantage of this known prior art in this respect is that, owing to the high melting point and the rheological properties of the chromium oxide melt, and also fundamentally, mixtures of chromium oxide and titanium oxide have poor melting properties. This leads to a low application rate during the plasma spraying process, and this in turn has the effect that the layer is expensive in terms of raw material and process costs, since a multi-stage application is required to arrive at a sufficient layer thickness.

BRIEF SUMMARY OF THE INVENTION

It is therefore an object of the invention to develop the known prior art in such a way that the raw materials can be better processed, as a result of which the application rate can be increased and therefore the raw material and process costs can be reduced.

The object is achieved in terms of the roll by the characterizing features of claim 1 and in terms of the method by the characterizing features of claim 12, in each case in combination with the generic features.

According to the invention, it is provided here that the roll comprises at least one ceramic layer which at least partially comprises an oxidic compound in the form of a mixed-oxide ceramic.

The mixed-oxide ceramic, which has been mixed, melted and brought into a substantially single-phase state before application to the roll, is considerably more economical to process than the individual metal oxide components of the conventional oxide-ceramic coatings as per the prior art. The application rate can be virtually doubled, which reduces the production time and thus lowers the process costs.

Furthermore, the oxidic compound in the form of a mixed-oxide ceramic can be used in a manner which saves more material, since the losses during processing are lower than in the case of the application of two or more individual metal oxides.

Further advantageous aspects of the invention become apparent from the dependent claims.

In this respect, the mixed-oxide ceramic advantageously comprises at least two metal oxides, these being melted and mixed before application to the roll.

According to an advantageous aspect of the invention, the metal oxides can be selected from chromium oxide ($Cr_2O_3$), titanium oxide ($TiO_2$), aluminum oxide ($Al_2O_3$), zirconium oxide ($ZrO_2$), silicon oxide ($SiO_2$), yttrium oxide ($Y_2O_3$). Said oxides are commercially available at low cost.

The mixed-oxide ceramic can preferably be present in the form of $Cr_2Ti_2O_7$ or $Al_2TiO_3$.

According to an advantageous aspect of the invention, the mixed-oxide ceramic $Cr_2Ti_2O_7$ can be produced on the basis of a mixing ratio of 50% to 95%, preferably 55% to 80%, $Cr_2O_3$ and 3% to 50%, preferably 20% to 45%, $TiO_2$.

According to an advantageous development of the invention, it can be provided that the at least one ceramic layer comprising at least one mixed-oxide ceramic is at least partially covered by at least one further ceramic layer. It is thereby possible to advantageously combine a cost reduction achieved by the mixed-oxide ceramic compared to the pure oxide ceramic with the performance of the pure oxide ceramic.

The at least one further ceramic layer can preferably likewise comprise a metal oxide which can be selected in a degree of purity of 99.9%, as a result of which the corrosion resistance can be improved.

In this respect, the metal oxide of the at least one further layer can be selected from chromium oxide ($Cr_2O_3$), titanium oxide ($TiO_2$), aluminum oxide ($Al_2O_3$), zirconium oxide ($ZrO_2$), silicon oxide ($SiO_2$), yttrium oxide ($Y_2O_3$).

It is preferable for the at least one ceramic layer, which comprises the mixed-oxide ceramic, to have a thickness of at least 100 to 1200 μm. This ensures an adequate wear resistance given the line loads to be expected in diverse positions in the fibrous web machine.

According to an advantageous aspect of the invention, it can furthermore be provided that the roll has a seal on the outermost of the layers. This increases the corrosion resistance of the roll.

The seal can comprise a polymer or consist entirely of a polymer.

According to an advantageous further development of the invention, the method can comprise, as a further method step, the application of a further ceramic layer.

The further ceramic layer can preferably comprise a metal oxide of 99.9% purity which covers the ceramic layer at least in certain regions. The further ceramic layer ensures a higher abrasion resistance, a reduced tendency toward corrosion and improved sheet dispensing properties.

In a further, optional method step, a seal can be provided by a polymer or a polymer-containing mixture on the mixed-oxide ceramic or the further ceramic layer.

BRIEF DESCRIPTION OF THE SEVERAL VIEWS OF THE DRAWING

The invention will be described in more detail hereinbelow with reference to the exemplary drawings. In the figures.

DESCRIPTION OF THE INVENTION

Figure 1:
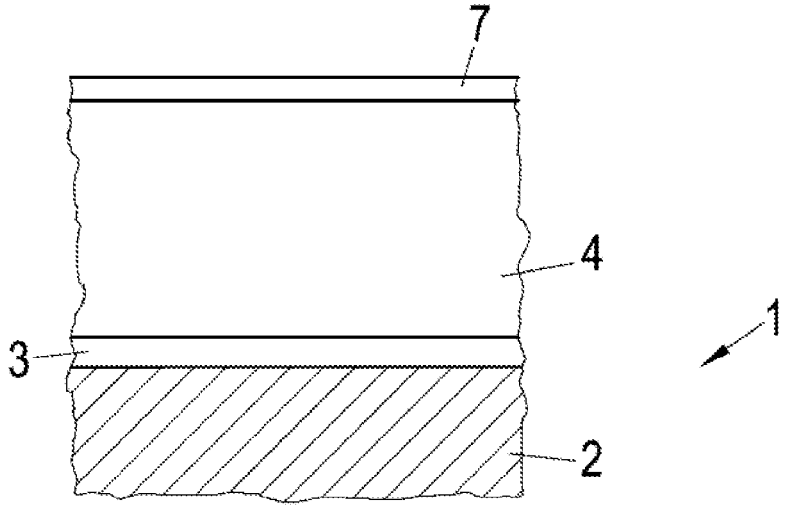
FIG. 1 shows a highly schematic sectional view in the form of a detail through a first exemplary embodiment of a roll formed according to the invention.

FIG. 1 shows a highly schematic sectional view of a detail of a roll 1 having the features according to the invention. To simplify the illustration, the roll curvature has been disregarded. It is likewise to be noted that the thickness of the individual layers of the roll 1 is not shown true to scale. The intention is merely to symbolize the sequence of the layers.

A roll 1 formed according to the invention usually has a roll core 2, which can consist of a metal such as steel or, in recent times, also of a plastic, in particular a fiber-reinforced plastic.

The roll 1 can be used in various positions in a machine for producing or processing a web of fibrous material, such as a paper, paperboard or tissue web. The text which follows deals particularly with the position of the central press roll in the press section of a fibrous web machine, since it is in this position that technically the highest demands are made on the roll 1 and the coating thereof. This applies in particular to the sheet dispensing properties, the wear resistance under high line loads in press nips and the corrosion resistance in wet surroundings.

A bonding layer 3 is firstly provided on the roll core 2 and serves to promote adhesion between the roll core 2 and the subsequent layer. Since the bonding layer 3 can be formed as per the prior art and is therefore known, a detailed description thereof can be omitted. According to the invention, a first ceramic layer 4 consisting at least partially of an oxidic compound in the form of a mixed-oxide ceramic is formed on the bonding layer 3. Technically, oxidic compounds of this type are also referred to as MMO (Mixed Metal Oxides).

According to the invention, a mixed-oxide ceramic of this type is a ceramic which is composed of at least two different metal oxides and is brought into a substantially single-phase state before it is processed on the roll 1. This is effected by mixing and melting the individual metal oxide components before they are sprayed onto the surface of the bonding layer 3.

Methods of this type are already known and usually comprise the following steps: mixing the metal oxides, melting the mixture, for example in an electric arc furnace, solidifying the melt, breaking the melt which has solidified in irregular shapes, grinding and possible posttreatment steps of a thermal nature and also sieving and sifting. Other methods comprising melting and atomizing or sintering are likewise known.

Preferred metal oxides can be chromium oxide, titanium oxide, aluminum oxide, yttrium oxide, zirconium oxide or silicon oxide. Two or more of these are mixed and melted before processing, in order to then be applied to the roll. The processing is performed by means of conventional guns used in HVOF or flame spraying methods.

A preferred embodiment provides for the use of a mixture of chromium oxide and titanium oxide in a mixing ratio of 50% to 95%, preferably 55% to 80%, $Cr_2O_3$ and 3% to 50%, preferably 20% to 45%, $TiO_2$. The mixed-oxide ceramic is then present in substantially single-phase form as $Cr_2Ti_2O_7$.

The oxidic compounds have various advantages: they are easier to process, since the melting and mixing are not performed during the flame spraying operation, and therefore can be applied considerably more effectively. The processing speed in this case can be up to twice that of conventional mixed ceramics present merely as a mixture of the metal oxides. The required layer thickness of at least 100 μm is thus achieved within a considerably shorter time, and this makes the production more economical. The layer thicknesses indicated are unalterable on account of the line loads to be expected, for example, in press positions of a fibrous web machine.

The better melting behavior of the substantially single-phase mixed-oxide ceramic makes it possible for the pulling-off resistance to be improved. This means that the ceramic layer 4 comprising the mixed-oxide ceramic adheres more effectively to the bonding layer 3 than a pure metal oxide, for example chromium oxide. This increases the reliability in terms of spalling between the bonding layer 3 and the ceramic layer 4.

A seal 7 which, for example, comprises a polymer or consists entirely of a polymer can be provided as corrosion protection on the layer 4 which makes contact with the fibrous web.

Figure 2:
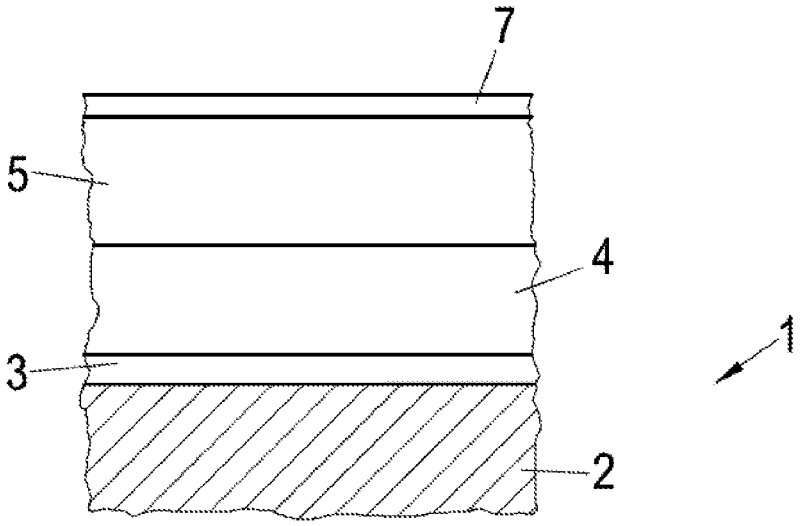
FIG. 2 shows, in the same view as in FIG. 1, a second exemplary embodiment of a roll formed according to the invention.

In an identical illustration to that in FIG. 1, FIG. 2 shows a second exemplary embodiment of the invention. In contrast to the exemplary embodiment shown in FIG. 1, here a layer structure having two ceramic layers 4, 5 is shown. In this case, a further ceramic layer 5 comprising a pure metal oxide, for example chromium oxide, is applied to the ceramic layer 4, which contains or consists of the mixed-oxide ceramic. Said pure metal oxide is present in a high purity, for example in a degree of purity 3N (99.9%).

This improves the performance of the roll in combination with a reduction in costs and thus affords a considerable improvement for the customer. The sheet dispensing properties, the wear resistance and the corrosion resistance are improved compared to conventional multi-phase ceramic layers, since $Cr_2O_3$ is harder and therefore no selective release of more unstable oxides is effected. The metal oxides suitable for producing the mixed-oxide ceramic can be used in turn as the pure metal oxide, that is chromium oxide ($Cr_2O_3$), titanium oxide ($TiO_2$), aluminum oxide ($Al_2O_3$), zirconium oxide ($ZrO_2$), silicon oxide ($SiO_2$), yttrium oxide ($Y_2O_3$), with chromium oxide ($Cr_2O_3$) being preferred.

The invention claimed is:

1. A roll for use in a machine for producing or finishing a web of fibrous material, the roll comprising:

a roll core;

at least one bonding layer formed on said roll core;

at least one ceramic layer formed on said at least one bonding layer, said at least one ceramic layer being at least partially formed of an oxidic compound in the form of a mixed-oxide ceramic $Cr_2Ti_2O_7$ produced on the basis of a mixing ratio of 50% to 95% $Cr_2O_3$ and 3% to 50% $TiO_2$.

2. The roll according to claim 1, wherein said mixed-oxide ceramic comprises at least two metal oxides.

3. The roll according to claim 2, wherein said metal oxides are selected from the group consisting of chromium oxide, titanium oxide, aluminum oxide, zirconium oxide, silicon oxide, and yttrium oxide.

4. The roll according to claim 1, wherein the mixing ratio is 20% to 45% $TiO_2$ and 55% to 80% $Cr_2O_3$.

5. The roll according to claim 1, wherein said at least one ceramic layer comprising at least one mixed-oxide ceramic is at least partially covered by at least one further ceramic layer.

6. The roll according to claim 5, wherein said at least one further ceramic layer comprises a metal oxide having a degree of purity of 99.9%.

7. The roll according to claim 6, wherein said metal oxide of said at least one further layer is selected from the group consisting of chromium oxide, titanium oxide, aluminum oxide, zirconium oxide, silicon oxide, and yttrium oxide.

8. The roll according to claim 1, wherein said at least one ceramic layer, which comprises the mixed-oxide ceramic, has a thickness of at least 100 to 1200 μm.

9. The roll according to claim 1, which comprises a seal formed on an outermost said layer of the roll.

10. The roll according to claim 9, wherein said seal comprises a polymer.

11. The roll according to claim 9, wherein said seal consists of a polymer.

12. A method for producing a roll for a machine for producing or finishing a web of fibrous material, wherein the method comprises the following steps:

i) preparing an oxidic compound to form a mixed-oxide ceramic by mixing and melting $Cr_2O_3$ and $TiO_2$ at a mixing ratio of 50% to 95% $Cr_2O_3$ and 3% to 50% $TiO_2$ ii) producing a bonding layer on a roll core;

iii) applying the oxidic compound in the form of a mixed-oxide ceramic $Cr_2Ti_2O_7$ by an application method to form a ceramic layer on the bonding layer;

to thereby form the roll having the roll core, the at least one bonding layer on the roll core and at least one ceramic layer on the bonding layer.

13. The method according to claim 12, which comprises producing the roll suitable for processing paper web, paperboard web or tissue web.

14. The method according to claim 12, which comprises, as a further method step, applying a further ceramic layer.

15. The method according to claim 14, wherein the further ceramic layer comprises a metal oxide of 99.9% purity which covers the ceramic layer at least in certain regions.

16. The method according to claim 12, which further comprises applying a sealing layer consisting entirely or partially of a polymer.

* * * * *